US008493230B2

(12) United States Patent
Hikita et al.

(10) Patent No.: US 8,493,230 B2
(45) Date of Patent: Jul. 23, 2013

(54) ELEVATOR EVACUATION SUPPORTING SYSTEM

(75) Inventors: Shiro Hikita, Tokyo (JP); Kiyoji Kawai, Tokyo (JP); Masahiko Konishi, Tokyo (JP); Masafumi Iwata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 372 days.

(21) Appl. No.: 12/992,925

(22) PCT Filed: Aug. 27, 2008

(86) PCT No.: PCT/JP2008/065300

§ 371 (c)(1),
(2), (4) Date: Nov. 16, 2010

(87) PCT Pub. No.: WO2010/023736

PCT Pub. Date: Mar. 4, 2010

(65) Prior Publication Data

US 2011/0128159 A1 Jun. 2, 2011

(51) Int. Cl.
*G08B 5/00* (2006.01)

(52) U.S. Cl.
USPC ..... 340/815.4; 340/691.6; 340/286.05

(58) Field of Classification Search
USPC ..... 340/815.4, 577, 691.6, 693.6, 286.05, 340/287; 187/313–314, 391–392, 390, 239
See application file for complete search history.

(56) References Cited

U.S. PATENT DOCUMENTS 4,865,155 A * 9/1989 Montaigne et al. ..... 182/14
5,253,734 A * 10/1993 Laurutis ..... 187/239
5,979,607 A * 11/1999 Allen ..... 187/390
2006/0201751 A1* 9/2006 Kawai ..... 187/313
2008/0196978 A1* 8/2008 Siikonen et al. ..... 187/384

FOREIGN PATENT DOCUMENTS

| | | |
|---|---|---|
| JP | 52 85000 | 7/1977 |
| JP | 60 137792 | 7/1985 |
| JP | 4 159985 | 6/1992 |
| JP | 5 92882 | 4/1993 |
| JP | 7 157215 | 6/1995 |
| JP | 02003063760 A * | 3/2003 |
| JP | 2005 104630 | 4/2005 |
| JP | 2007 131362 | 5/2007 |
| JP | 2008 184303 | 8/2008 |

OTHER PUBLICATIONS

Korean Office Action issued Jun. 8, 2012, in Korea Patent Application No. 10-2010-7025903 (with partial English translation).
U.S. Appl. No. 13/144,088, filed Jul. 12, 2011, Iwata, et al.
Chinese Office Action issued Aug. 28, 2012, in China Patent Application No. 200880130094.7 (with partial English translation).
International Search Report issued Apr. 7, 2009 in PCT/JP08/65300 filed Aug. 27, 2008.
Office Action issued Jan. 29, 2013 in Japanese Patent Application No. 2010-526458 with partial English language translation.

* cited by examiner

*Primary Examiner* — Daniel Previl
(74) *Attorney, Agent, or Firm* — Oblon, Spivak, McClelland, Maier & Neustadt, L.L.P.

(57) ABSTRACT

Provided is an elevator evacuation supporting system which can appropriately guide people living in a building to the hall of an elevator in the case of occurrence of a disaster. For this purpose, the elevator evacuation supporting system includes an elevator provided in a building, an evacuation operation device which, in the case of occurrence of a disaster in the building, selects service floors of the elevator from floors of the building according to the disaster condition of the building, and causes the elevator to perform an evacuation operation for ascent and descent between the service floors, a passage indication device provided in a passage leading to a hall of the elevator, and an escape routes display device which, during the evacuation operation of the elevator, causes the passage indication device provided in a passage leading to a hall of the elevator of the service floor to indicate escape routes to the hall of the elevator of the service floor according to the disaster condition of the service floor.

6 Claims, 4 Drawing Sheets

ELEVATOR EVACUATION SUPPORTING SYSTEM

TECHNICAL FIELD

The present invention relates to an elevator evacuation supporting system which efficiently performs evacuation by using an elevator when disasters such as fires occur in high-rise buildings and the like.

BACKGROUND ART

In general, when disasters such as fires occur in buildings, each elevator travels to the nearest floor in order to prevent secondary disasters mainly by the elevator and then often stops subsequent operations. In recent buildings, however, fire protection partitions and other techniques have been improved and floors except the floor on which a fire has broken out and floors in the vicinity of this floor are less affected by the fire, and the ordinary operation of elevators may sometimes be safely continued.

An elevator operation method in which the above-described background is considered has been proposed. In this operation method, on the basis of a detected place where a fire has broken out, an elevator evacuation operation method is prepared so as to avoid the fire and fire protection partitions. And the operation of each elevator is controlled on the prepared evacuation operation method. By performing such control, evacuation is carried out more swiftly than in the case where only stairs are used (refer to Patent Document 1, for example).

Patent Document 1: Japanese Patent Laid-Open No. 2005-104630

DISCLOSURE OF THE INVENTION

Problems to be Solved by the Invention

In recent years, fire protection partitions and other techniques have been further improved and elevator evacuation operations in which even the floor on which a fire has broken out is used as a service floor may sometimes be carried out. However, in the elevator evacuation operation method described in Patent Document 1, a method of evacuation guidance to an elevator hall is not described.

The present invention has been made to solve the problem described above and the object of the invention is to provide an elevator evacuation supporting system which can appropriately guide the people living in a building to an elevator hall in the case of occurrence of a disaster.

Means for Solving the Problems

An elevator evacuation supporting system includes an elevator provided in a building, an evacuation operation device which, in the case of occurrence of a disaster in the building, selects service floors of the elevator from floors of the building according to the disaster condition of the building, and causes the elevator to perform an evacuation operation for ascent and descent between the service floors, a passage indication device provided in a passage leading to a hall of the elevator, and an escape routes display device which, during the evacuation operation of the elevator, causes the passage indication device provided in a passage leading to a hall of the elevator of the service floor to indicate escape routes to the hall of the elevator of the service floor according to the disaster condition of the service floor.

Advantages of the Invention

According to the present invention, in the case of occurrence of a disaster, it is possible to appropriately guide the people living in a building to an elevator hall.

DESCRIPTION OF SYMBOLS

1 each-unit controller, 2 hall lantern, 3 elevator group controller, 4 disaster-preventive controller, 5 fire detector, 6 emergency broadcaster, 7 elevator evacuation supporting system, 8 evacuation operation device, 9 passage indication device, 10 accessible area indication device, 11 escape routes planning device, 12 escape routes display device, 13 accessible area indication and instruction device, 14,15 stair, 16 elevator

BEST MODE FOR CARRYING OUT THE INVENTION

The best mode for carrying out the present invention will be described with reference to the accompanying drawings. Incidentally, in each of the drawings, like numerals refer to like or corresponding parts and overlaps of description of these parts are appropriately simplified or omitted.

Embodiment 1

Figure 1:
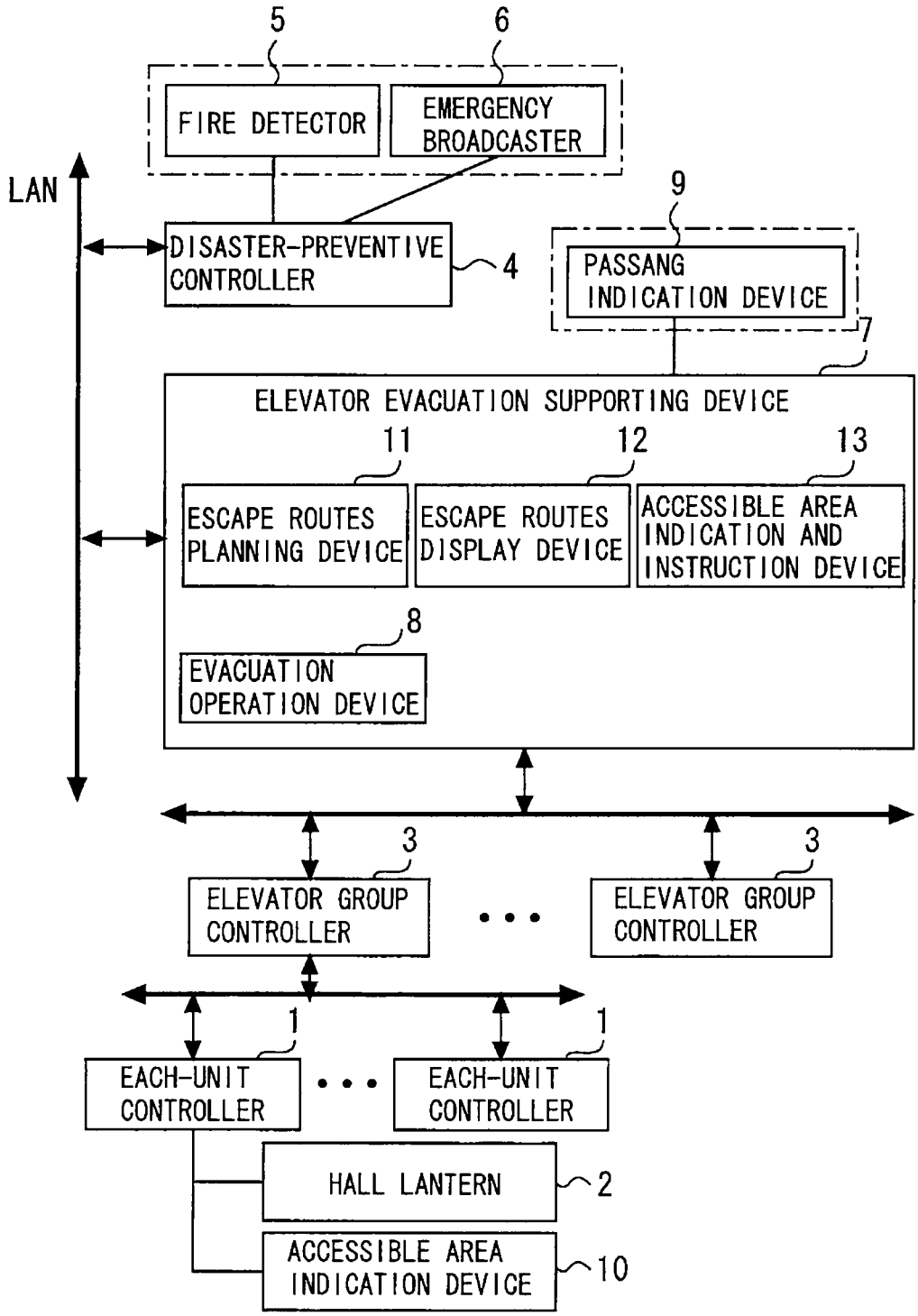
FIG. 1 is a general block diagram of an elevator evacuation supporting system in Embodiment 1 of the present invention.

FIG. 1 is a general block diagram of an elevator evacuation supporting system in Embodiment 1 of the present invention.

In FIG. 1, reference numeral 1 denotes an each-unit controller of elevators. These each-unit controllers 1 have the function of controlling the whole of each elevator, such as the elevator arrival indication control of a hall lantern 2 and chime ring control. Reference numeral 3 denotes an elevator group controller. These elevator group controllers 3 have the function of group supervisory control of a plurality of elevators sharing the same elevator halls via the each-unit controllers 1.

Reference numeral 4 denotes a disaster-preventive controller. This disaster-preventive controller 4 has the function of overall control of the disaster-preventive equipment in the whole building. Concretely, the disaster-preventive controller 4 has the function of controlling a fire detector 5, an emergency broadcaster 6 and the like provided on each floor. The fire detector 5 has the function of detecting a fire which breaks out on each floor. The emergency broadcaster 6 has the function of making announcements about evacuation guidance and the like when the fire detector 5 has detected a fire.

The elevator group controller 3 and disaster-preventive controller 4 of the above-described configuration are connected to an elevator evacuation supporting system 7. This elevator evacuation supporting system 7 is provided with an emergency operation device 8. This evacuation operation device 8 has the function of selecting service floors from the floors of the building for each of the plurality of elevators according to the fire condition of each floor when the fire detector 5 on each floor has detected a fire. The evacuation operation device 8 has the function of sending information about the service floors to the elevator group controller 3. The elevator group controller 3 controls each-unit controller 1 on the basis of the information about the service floors. Under such control, each elevator carries out an evacuation operation by performing ascent and descent between the service floors selected by the evacuation operation device 8.

In this embodiment, a passage indication device 9 consisting of a display is provided in a passage leading to the elevator hall on each floor of the building. An accessible area indication device 10 is provided in the elevator hall. Furthermore, the elevator evacuation supporting system 7 is provided with escape routes planning device 11, escape routes display device 12 and an accessible area indication and instruction device 13.

The escape route planning device 11 has the function of planning escape routes to the elevator hall of a service floor according to the fire condition while an elevator is performing an evacuation operation. The escape route planning device 11 has the function of simultaneously planning escape routes to stairs from the service floor to the adjoining floors.

The escape route display device 12 has the function of causing the passage indication device 9 provided in a passage leading to the elevator hall of the service floor to indicate escape routes to the elevator hall of the service floor and escape routes to the stairs from the service floor to the adjoining floors on the basis of the planning results of the escape route planning device 11. The accessible area indication and instruction device 13 has the function of causing the accessible area indication device 10 provided in the hall of the elevator of the service floor to indicate areas corresponding to the number of passengers capable of boarding the car, which is calculated on the basis of the rated number of passengers and the number of passengers in the car while an elevator is performing an evacuation operation.

Next, an evacuation guidance indication expected in the case of a fire will be described with the aid of FIGS. 2 and 3.

Figure 2:
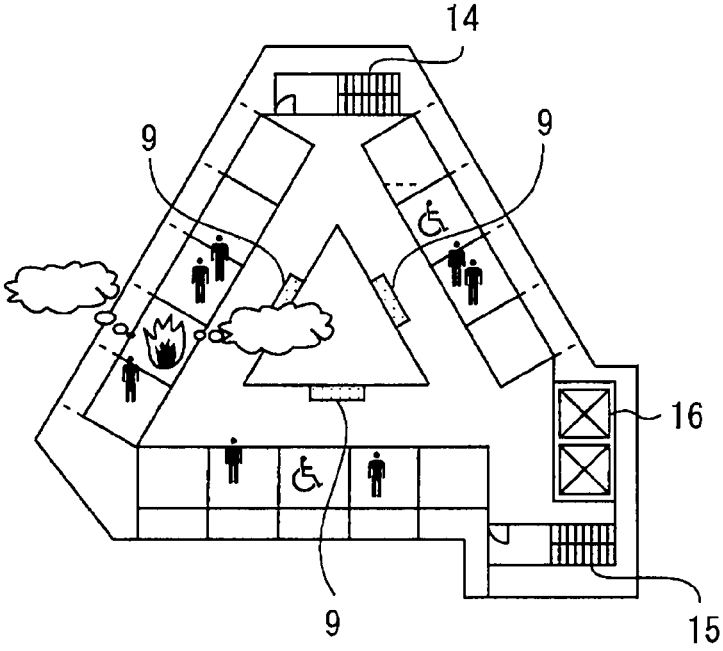
FIG. 2 is a diagram to explain the case where a fire has broken out in the building in which the elevator evacuation supporting system in Embodiment 1 of the present invention is installed.

FIG. 2 is a diagram to explain the case where a fire has broken out in the building in which the elevator evacuation supporting system in Embodiment 1 of the present invention is installed.

As shown in FIG. 2, the building has a substantially triangular cross section. In the middle part of this building, a supporting column having a substantially triangular cross section is provided. A plurality of rooms are provided along the inner side of each side wall of the building. Furthermore, stairs 14 are provided at the upper corner of the building. On the other hand, at the lower rightward corner of the building, stairs 15 and an elevator 16 are provided. Between each of the rooms and the supporting column, a passage leading to the elevator hall is provided. A passage indication device 9 is provided on each side surface of the supporting column.

Figure 3:
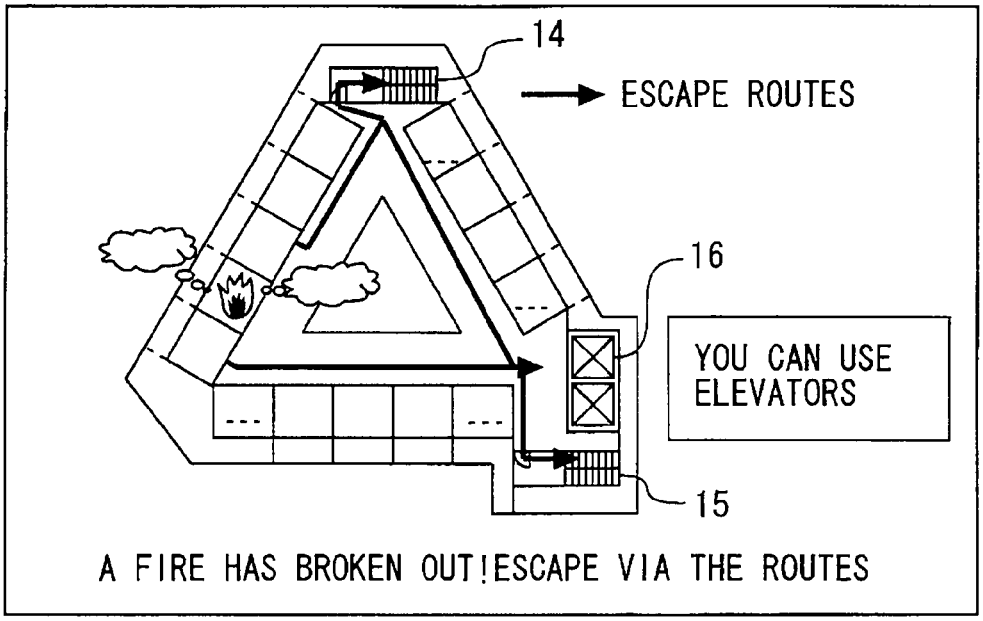
FIG. 3 is a diagram to explain the evacuation guidance indication of the elevator evacuation supporting system in Embodiment 1 of the present invention.

FIG. 3 is a diagram to explain the evacuation guidance indication of the elevator evacuation supporting system in Embodiment 1 of the present invention.

An indication screen of the passage indication device 9 is shown in FIG. 3. Concretely, the room in which the fire has broken out and escape routes are shown. More concretely, the fire has broken out in the first room from the bottommost room along the inner side of the side wall on the left side of the building.

On this occasion, escape routes to the elevator hall using the lower passage is indicated to the bottommost room along the inner side of the side wall on the left side of the building and the rooms along the inner side of the side wall in the lower part of the building. On the other hand, escape routes to the elevator hall using the passage in a clockwise direction is indicated to the rooms along the inner side of the left side of the building from the middle part to the upper part of the building and the rooms along the inner side of the side wall on the right side of the building. It is indicated that also the stairs 14, 15 can be used. Furthermore, the messages "A FIRE HAS BROKEN OUT! ESCAPE VIA THE ROUTES" and "YOU CAN USE ELEVATORS" are indicated.

Next, indications in the hall to be provided in the case of a fire will be described with the aid of FIG. 4.

Figure 4:
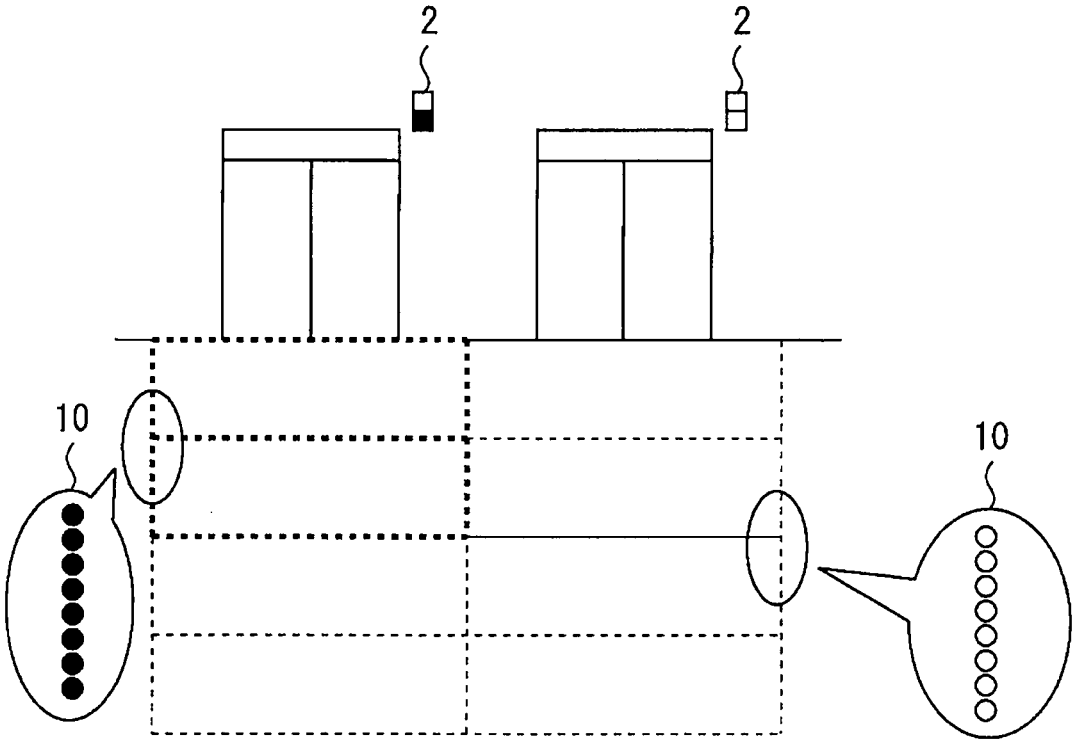
FIG. 4 is a diagram schematically showing the hall of elevators in which the elevator evacuation supporting system in Embodiment 1 of the present invention is used.

FIG. 4 is a diagram schematically showing the hall of elevators in which the elevator evacuation supporting system in Embodiment 1 of the present invention is used.

In FIG. 4, the accessible area indication device 10 consists of a lamp-type indicator buried in the floor of the elevator hall. This accessible area indication device 10 has the function of indicating only areas corresponding to the number of passengers capable of boarding the car in a lighted-up condition. As a result of this, on the floor selected as the service floor for at least one of a plurality of elevators, elevators responding to the floor selected as the service floor are also indicated.

Next, the operation of the elevator evacuation supporting system will be described with the aid of FIG. 5.

Figure 5:
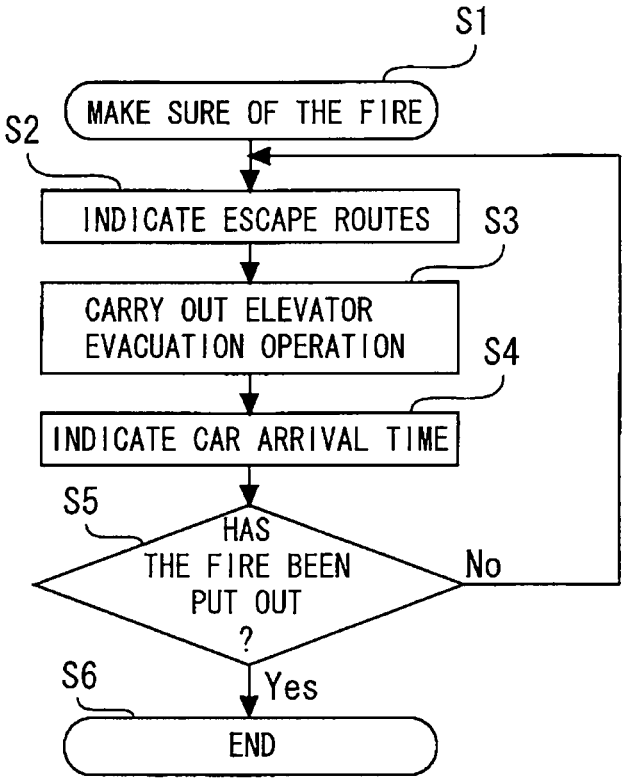
FIG. 5 is a flowchart to explain the operation of the elevator evacuation supporting system in Embodiment 1 of the present invention.

FIG. 5 is a flowchart to explain the operation of the elevator evacuation supporting system in Embodiment 1 of the present invention.

First, in Step S1, the occurrence of a fire is detected by the fire detector 5. As a result of this, the occurrence of the fire is made sure of, and the flow of operation proceeds to Step S2. In Step S2, the guidance indication and announcement of escape routes are performed by the passage indication device 9 and the emergency broadcaster 6 according to the fire condition of the place where the fire has broken out and the like.

Immediately thereafter, in Step S3, the evacuation operation of the elevator is performed according to the fire condition. In this evacuation operation, for example, the method disclosed in Japanese Patent Laid-Open No. 2005-104630 can be adopted. During the evacuation operation, in Step S4, as the car arrival time indication, only areas corresponding to the number of passengers capable of boarding the car are indicated in a lighted-up condition on the accessible area indication device 10. After that, in Step S5, a judgment is made as to whether or not the fire has been put out. Unless the fire has been put out, the flow of operation returns to Step S2. On the other hand, when the fire has been put out, the flow of operation proceeds to Step S6, where the evacuation operation is finished.

Conditions for the judgment on the finish of fire fighting in Step S5 include the case where the operation is judged to be finished on the basis of the judgment of the disaster-preventive persons, the fire-fighting persons and the like and the finish of the operation is manually inputted, and the case where by use of sensors of equipment related to elevators, such as an ascent/descent sensor, the boarding at the service floors is not performed anymore and the completion of the evacuation is automatically judged.

According to Embodiment 1 described above, while an elevator is performing an evacuation operation, escape routes to the elevator hall of a service floor are indicated on the passage indication devices 9 provided in the passage leading to the elevator hall of the service floor according to the fire condition of the service floor. For this reason, it is possible to appropriately guide the people living in the building to the elevator hall.

While an elevator is performing an evacuation operation, only areas corresponding to the number of passengers capable of boarding the car are indicated in a lighted-up condition in the accessible area indication device 10 provided in the elevator hall of a service floor. As a result of this, it is possible to prevent unwanted confusion even in the case where many passengers want to board the car which has arrived during evacuation because of a fire and the car is expected to become packed to capacity.

Furthermore, the accessible area indication device 10 consists of a lamp-type indicator provided in the floor of an elevator hall. For this reason, even when the elevator hall is filled with the smoke generated by the fire, it is possible to positively visually recognize the number of passengers capable of boarding the car.

In addition, while a plurality of elevators are performing an evacuation operation, on the accessible area indication device 10 provided in the elevator hall of a floor selected as the service floor for at least one of the plurality of elevators, elevators responding to the floor selected as the service floor are indicated. For this reason, it is possible to inform the evacuees of which elevator is going to stop.

While an elevator is performing an evacuation operation, on passage indication devices 9 provided in the passage leading to the elevator hall of a service floor, escape routes to the stairs 14, 15 leading from the service floor to the adjoining floors are indicated according to the fire condition of the service floor. For this reason, it is possible to appropriately guide the people living in the building in the evacuation even when no elevator can be used because the car is full.

In Embodiment 1, the description was given of the evacuation method to be adopted in the case of a fire. However, even in the case of disasters such as a flood disaster, the same effect is obtained by causing the passage indication device 9 to indicate escape routes according to the disaster. In Embodiment 1, the passage indication device 9 is provided only in the passage of each floor. However, even when the passage indication device 9 is provided in other places such as the stairs 14, 15, the same effect is obtained. Furthermore, the passage indication device 9 is not limited to a display. For example, a device which lights up an arrow indicating the direction of escape routes only during evacuation may be caused to indicate escape routes.

INDUSTRIAL APPLICABILITY

As described above, the elevator evacuation supporting system of the present invention can be applied to elevators which appropriately guide the people living in a building in the evacuation.

The invention claimed is:

1. An elevator evacuation supporting system, comprising:

an elevator installed in a building;

an evacuation operation device which, in the case of occurrence of a disaster in the building, selects service floors of the elevator from floors of the building according to the disaster condition of the building, and causes the elevator to perform an evacuation operation for ascent and descent between the service floors;

a passage indication device provided in a passage leading to a hall of the elevator; and an escape routes display device which, during the evacuation operation of the elevator, causes the passage indication device provided in a passage leading to a hall of the elevator of the service floor to indicate escape routes to the hall of the elevator of the service floor according to the disaster condition of the service floor.

2. The elevator evacuation supporting system according to claim 1, further comprising:

an accessible area indication device provided in the hall of the elevator; and an accessible area indication and instruction device which, during the evacuation operation of the elevator, causes the accessible area indication device provided in the hall of the elevator of the service floor to indicate the number of passengers capable of boarding a car, which is calculated on the basis of the rated number of passengers of the car and the number of passengers in the car.

3. The elevator evacuation supporting system according to claim 2, wherein the accessible area indication device comprises a lamp-type indicator provided on the floor of the hall of the elevator, and wherein the accessible area indication and instruction device, during the evacuation operation of the elevator, causes the accessible area indication device provided in the hall of the elevator of the service floor to indicate the number of passengers capable of boarding the car in a lighted-up condition.

4. The elevator evacuation supporting system according to claim 2, wherein the elevator comprises a plurality of elevators sharing the halls of the elevator, wherein the evacuation operation device selects the service floors for each of the plurality of elevators and causes the plurality of elevators to perform the evacuation operation, and wherein the accessible area indication and instruction device causes, during the evacuation operation of the plurality of elevators, an accessible area indication device provided in the hall of the elevator selected as a service floor for at least one of the plurality of elevators to indicate an elevator responsive to the floor selected as the service floor.

5. The elevator evacuation supporting system according to claim 2, wherein the escape routes display device causes, during the evacuation operation of the elevator, a passage indication device provided in a passage leading to the hall of the elevator of the service floor to indicate escape routes to stairs leading from the service floor to adjoining floors according to the disaster condition of the service floor.

6. The elevator evacuation supporting system according to claim 1, further comprising an escape routes planning device which, during the evacuation operation of the elevator, plans escape routes to the elevator hall of a service floor according to the fire condition, wherein the escape routes display device causes the passage indication device to indicate at least one of the escape routes planned by the escape routes planning device.

* * * * *